United States Patent [19]

Hayes

[11] 4,349,104

[45] Sep. 14, 1982

[54] SCENTED DISPOSAL BAG

[76] Inventor: Paul R. Hayes, 806 S. Westvale Dr., Anaheim, Calif. 92804

[21] Appl. No.: 232,811

[22] Filed: Feb. 9, 1981

[51] Int. Cl.[3] ..... B65D 47/10; B65D 81/00

[52] U.S. Cl. ..... 206/205; 206/216; 206/554; 150/11; 229/63

[58] Field of Search ..... 206/213.1, 205, 210, 206/216, 554; 150/11; 222/187; 229/63

[56] References Cited

U.S. PATENT DOCUMENTS

| | | | |
|---|---|---|---|
| 2,186,384 | 1/1940 | Lester | 150/11 |
| 4,105,144 | 8/1978 | Lin | 206/205 |
| 4,202,472 | 5/1980 | Lin | 206/205 |
| 4,260,003 | 4/1981 | Hendrickson | 150/11 |

*Primary Examiner*—William T. Dixson, Jr.
*Attorney, Agent, or Firm*—G. Donald Weber, Jr.

[57] ABSTRACT

There is disclosed herewith a bag which is used for disposal of odorous material such as, but not limited to, sanitary napkins, tampons and the like. A scented or deodorizing material is selectively released within the bag when the bag is closed.

5 Claims, 5 Drawing Figures

SCENTED DISPOSAL BAG

BACKGROUND

1. Field of the Invention

This invention is directed to containers, in general, and to disposable containers such as bags and the like, in particular.

There are many known types of containers or bags. Many bags are known which have specific configurations and/or uses. For example, bags are known which have pleated configurations, folded bottoms to provide rectilinear bags, plastic bags, bags for food or sandwiches or the like. Bags are known to be made of paper, plastic material, woven material, or the like. Bags are also known which have drawstrings therein adjacent the top thereof in order to provide a secure closure of the bag. The bags may be produced in the form of reusable pouches, disposable units or the like. Some bags are even known to be moisture-proof and to be adapted for retaining unpleasant articles therein.

2. PRIOR ART STATEMENT

A search of the prior art has uncovered the following pertinent art.

U.S. Pat. No. 2,656,769 - Hultkrans, which is directed to a method of producing a reusable pouch having a drawstring.

U.S. Pat. No. 3,079,966 - Kugler, which is directed to a particular type of bag configuration which uses a drawstring for closure thereof.

U.S. Pat. No. 3,132,794 - Frazier, which is directed to a foldable bag or receptacle which uses a drawstring for closure.

U.S. Pat. No. 3,920,179 - Hall, which discloses a disposable, flexible, partitionable bag with a drawstring to effect the partitioning. The bag also includes a rigid support member and the patent discloses the concept of placing a deodorant pill therein to reduce the unpleasant odors of the material therein.

U.S. Pat. No. 4,036,363 - Kugler, which is directed to the automatic filling of bags and a bag having a top opening and a drawcord therein.

SUMMARY OF THE INSTANT INVENTION

The invention is directed to a generally flexible bag which is intended to be disposable. The bag includes a drawstring arrangement associated therewith. The drawstring arrangement is formed in such a manner that operation of the drawstring causes the release of a deodorant material within the confines of the bag. The bags can be formed in many configurations and stored in self-feeding cartons, boxes or the like.

DESCRIPTION OF A PREFERRED EMBODIMENT

Figure 1:
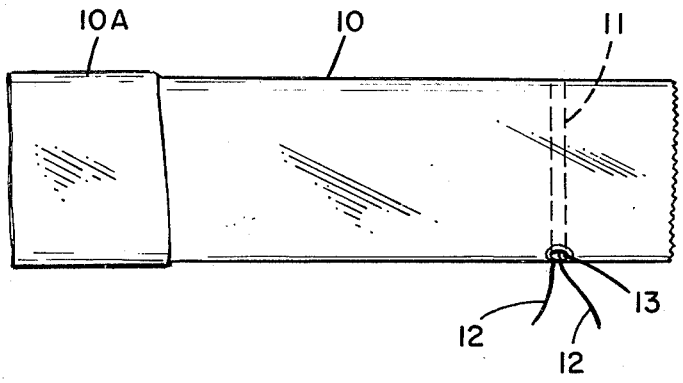
FIG. 1 is a plan view of a bag of the instant invention.

Referring now to FIG. 1, there is shown a plan view of one embodiment of the bag which forms the instant invention. The bag 19 is generally rectilinear in configuration and includes a foldable bottom 10A as well as an opening at the other end of the bag which is indicated by the serrated edge. A drawstring arrangement is shown in dashed outline and is generally formed within the bag. However, an external arrangement is not precluded from this invention. Typically, a drawstring 12 is included with the drawstring arrangement 11. The drawstring is arranged to extend outwardly from the bag through a suitable grommet means 13. In the embodiment shown in FIG. 1, a single grommet is disposed at one side of the bag. The single (or multiple) grommet 13 can be located in the central portion of the bag if so desired.

Figure 2:
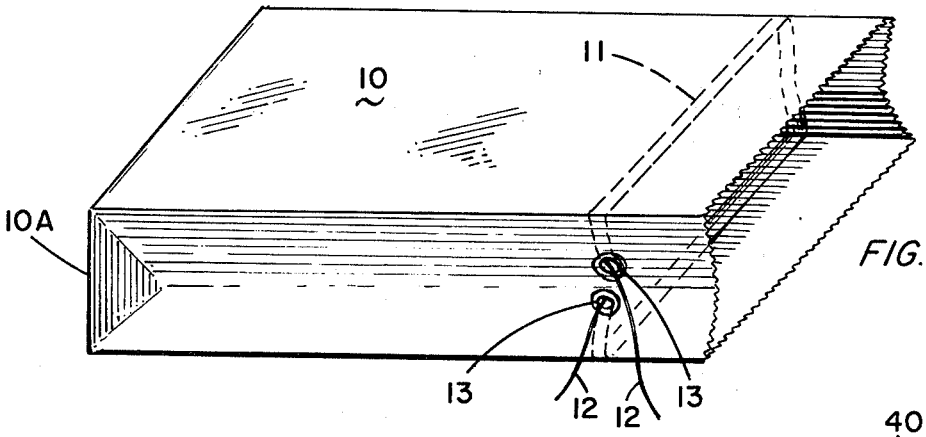
FIG. 2 is a perspective view of one embodiment of the bag in the instant invention.

Referring now to FIG. 2, there is shown a perspective view of the bag 10 of FIG. 1 in the opened position. Thus, bottom 10A has been folded essentially flat and the pleat lines are represented in order to suggest a relatively typical bag configuration. The string arrangement 11 is shown extending around the periphery of bag 10 with the ends of drawstring 12 extending out of grommets 13. In the embodiments shown in FIG. 2, the grommets 13 are disposed at the sides of the bag and a plurality of grommets is shown. As noted, relative to FIG. 1, the grommet can be located in the upper surface of bag 10 and more centrally located. Moreover, the grommets 13 can be combined as a single grommet with both ends of the string 12 extending therefrom.

Figure 3:
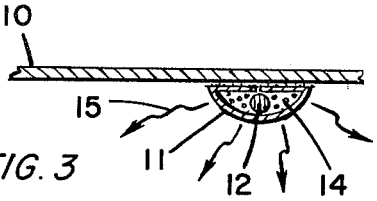
FIG. 3 is an enlarged view of one embodiment of the drawstring portion of the bag.

Referring now to FIG. 3, there is shown an enlarged, cross-sectional view of the drawstring portion of the bag. A portion of bag 10 is shown with the drawstring channel 11 attached or mounted at the inner surface thereof. In this embodiment, channel 11 is a separate unit which is glued to the bag surface 10. However, channel 11 may be formed directly in bag 10 if so desired. The drawstring 12 is disposed within the drawstring channel 11. A suitable deodorant or scented material 14 is included within drawstring channel 11. The arrows 15 indicate the dispersal of the deodorant or scented material 14 through the drawstring channel 11. That is, the scented or deodorant material 14 can be activated by pulling on drawstring 12 to be forced through channel 11. On the other hand, by pulling on drawstring 12, channel 11 may be selectively ruptured or the like to permit the material 14 to escape therefrom. The material 14 can be formed in a suitable manner or fashion. In point of fact, the scented material 14 may be associated with either channel 11 or with the drawstring 12 if deemed desirable. In any event, the arrangement permits the scent or deodorizing effect of material 14 to emanate from channel 11 as indicated by arrows 15 when drawstring 12 is operated.

Figure 4:
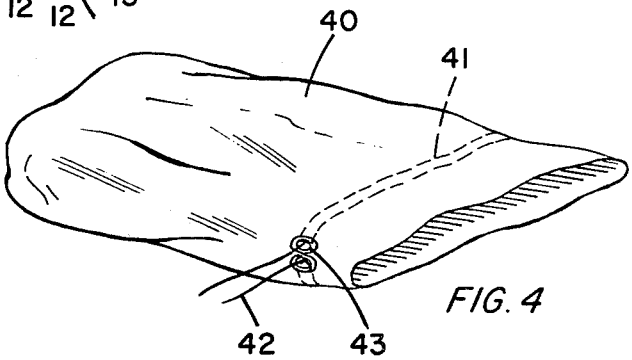
FIG. 4 is a perspective view of another embodiment of the instant invention.

Referring now to FIG. 4, there is shown another embodiment of the instant invention. In this particular embodiment, the bag 40 is similar to bag 10. A drawstring channel 41 is provided around bag 40. A drawstring 42 extends from the grommets 43 which can be singular or plural as noted above. The bag 40 shown in FIG. 4 is generally cylindrical in shape to indicate that the bag configuration is not limitative of the invention, per ser. In fact, other bag configurations are usable but are not described herein for purposes of brevity.

Figure 5:
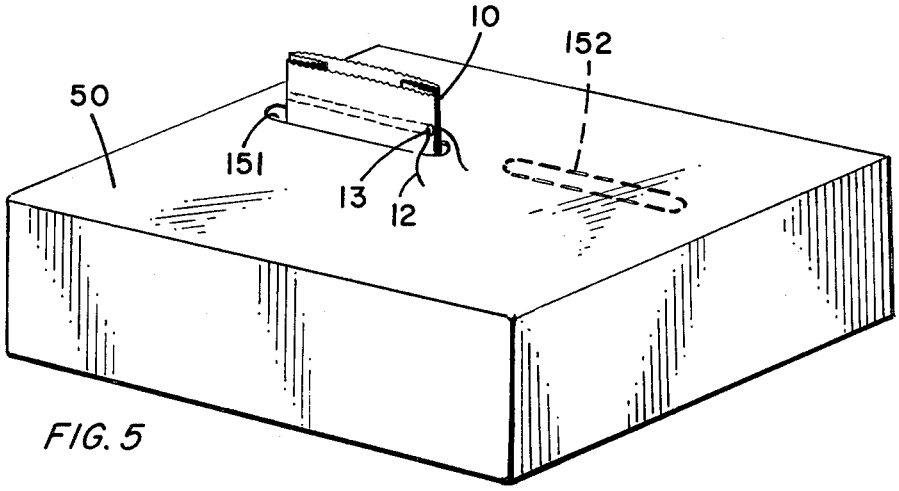
FIG. 5 is a perspective, schematic representation of a box or carton for supporting and supplying bags.

Referring now to FIG. 5, there is shown a suitable carton 50 or the like, which can be used for dispensing bags 10 (or bags 40, of course). The bags are stored within box 50 in a suitable fashion so that removing one bag 10 through slot 51 will automatically expose the next bag as is the case in many cleansing tissues or the like. An additional slot cover 52 is shown, in dashed outline. Thus, a dual dispenser carton 50 can be utilized. The size, shape and configuration of the carton or box 50 is not critical to the invention, per se, but is more directed to a dispensing operation.

In typical operation, the bag 10 is dispensed (or obtained) in a flat or folded condition. It is opened in a typical fashion and the tampon or sanitary napkin is inserted therein. The bag is then closed by pulling on drawstring 12 in the usual fashion. While pulling on drawstring 12, the drawstring channel 11 and the contents thereof are activated so that a deodorant or scented material is dispensed within the bag interior. Thus, the odoriferous contents of the bag are overcome. Inasmuch as the bag is formed of a moistureproof material of reasonable strength, the bag and its contents can be disposed of in any ordinary means such as trashcan or the like. It is not necessary to make or take any special precautions relative to the material. The bags can be printed on decorated in pastel colors and may have other decorative imprints thereon.

Thus, there has been shown and describd a disposable bag which is used especially for treating and disposing of odoriferous materials. The bag is of relatively standard configuration with the additional advantage of including a method and means for dispersing scented or deodorizing material within the confines of the bag. While certain bag configurations have been shown and described, other bag configurations can be utilized as well. The configurations shown and described are intended to be illustrative only and are not intended to be limitative. In point of fact, the many similar disposable bags which fall within the context of this description are intended to be included therein as well. The scope of the invention is limited only by the claims appended thereto.

Having thus described a preferred embodiment, what is claimed is:

1. A disposable bag unit comprising, a bag member comprising a generally tubular configuration with one open end and one closed end, said tubular member comprised of a flexible, disposable material, a drawstring arragement disposed on said bag adjacent to the open end thereof and adapted to close said open end when activated, and means containing an odor-related material associated with said drawstring arrangement to selectively disperse said odor-related material within the confines of the bag when the drawstring is activated.

2. The bag unit recited in claim 1, wherein, said odor-related material is a scented material.

3. The bag unit recited in claim 1, wherein, said odor-related material is a deodorant material.

4. The bag unit recited in claim 1, wherein said drawstring arrangement is disposed at the interior of said bag member.

5. The bag unit recited in claim 4, wherein, said bag member includes grommets through which a drawstring can pass to the exterior of the bag member.

* * * * *